US007331536B1

(12) United States Patent
Zhen et al.

(10) Patent No.: US 7,331,536 B1
(45) Date of Patent: Feb. 19, 2008

(54) SHOWER HEAD

(75) Inventors: Bruce Zhen, Taichung (TW); Sheng-Ping Hu, Taichung (TW)

(73) Assignee: Globe Union Industrial Corp. (GUIC), Taichung (TW)

( * ) Notice: Subject to any disclaimer, the term of this patent is extended or adjusted under 35 U.S.C. 154(b) by 19 days.

(21) Appl. No.: 11/486,218

(22) Filed: Jul. 14, 2006

(51) Int. Cl.
*A62C 31/00* (2006.01)

(52) U.S. Cl. ..... 239/449; 239/444; 239/446; 239/447; 239/558; 239/562; 239/583; 137/625.48; 251/213

(58) Field of Classification Search ..... 239/443, 239/444, 446, 447, 448, 449, 556, 558, 562, 239/583, 586; 137/625.48, 867, 868, 871; 251/213, 230
See application file for complete search history.

(56) References Cited

U.S. PATENT DOCUMENTS 3,722,800 A * 3/1973 Shames et al. ..... 239/447
6,145,757 A * 11/2000 Knapp ..... 239/443
6,290,147 B1 * 9/2001 Bertrand et al. ..... 239/444
6,370,713 B2 * 4/2002 Bosio ..... 239/562
6,619,567 B1 * 9/2003 Ouyoung ..... 137/625.48
7,000,854 B2 * 2/2006 Malek et al. ..... 239/449

* cited by examiner

*Primary Examiner*—Steven J. Ganey
(74) *Attorney, Agent, or Firm*—Ming Chow; Sinorica, LLC

(57) ABSTRACT

A shower head includes a main body formed with a chamber communicating with a water inlet at the upper end. The main body has its lower end formed with central water outlets and peripheral water outlets and has its interior installed with a water-separating unit with a pivot having a sealing member fixed thereon. When the pivot together with the sealing member is moved up and down vertically in the chamber, the sealing member can carry out sealing to control the water flowing in the chamber through the central water outlets or the peripheral water outlets. The main body has one circumferential side installed with a press unit formed with two pushing slopes actuated to move horizontally and push the pivot of the water-separating unit to shift up and down vertically for controlling the shower head to send out water through the center or the periphery.

10 Claims, 14 Drawing Sheets

SHOWER HEAD

BACKGROUND OF THE INVENTION

1. Field of the Invention

This invention relates to a shower head, particularly to one convenient in use and operation and having excellent sealing effect.

2. Description of the Prior Art

Most conventional spray heads can be optionally controlled to send out water through the center or plural holes in the periphery as disclosed in a U.S. Pat. No. 6,370,713. The shower head in this US patent includes a main body having its underside provided with a disc bored with a central water outlet and a plurality of peripheral water outlets. The main body is formed with a water passageway in the interior and a transverse chamber opposite to the water passageway. The transverse chamber has its interior horizontally provided with a rod with a sealing member, and a compression spring for actuating the rod to recover its original position. The rod is transversely inserted out of the main body and connected with a actuation lever for controlling the rod to let the sealing member seal up the sealing surface inside the transverse chamber so as to control water to flow out through the central water outlet or through the peripheral water outlets.

However, although the conventional shower head can be optionally controlled to send out water through the center or the periphery, yet the rod and the compression spring are horizontally installed in the interior of the transverse chamber. Therefore, the direction of gravitational force imposed upon the rod, the sealing member and the compression spring is not the in line with their working and shifting direction. As a result, the rod, the sealing member and the compression spring are likely to produce bias displacement; especially, the sealing member of the rod is liable to fall downward, unable to be evenly sealed on the sealing surface of the transverse chamber, not only worsening sealing but also damaging and shortening the service life of the sealing member as well.

SUMMARY OF THE INVENTION

The objective of the invention is to offer a shower head including a main body formed in the interior with a chamber communicating with a water inlet at the upper end. The main body has its lower end formed with central water outlets and peripheral water outlets. A water-separating unit provided with a pivot is installed in the interior of the main body. When the sealing member on the pivot is actuated to move up and down vertically in the chamber of the main body, the sealing member will carry out sealing to control and guide water coming from the water outlet to flow out through the central water outlets or the peripheral water outlets. The main body further has one circumferential side installed with a press unit formed with two pushing slopes able to be actuated to shift horizontally and push the pivot of the water-separating unit to move up and down vertically for controlling the shower head to send out water through the center or the periphery.

The shower head of this invention has the following advantages.

1. The shower head can be optionally controlled to send out water through the center or the periphery.

2. After being pressed, the press unit can be released immediately to let water sent out automatically, needless to be pressed continuously.

3. The water-separating unit of the shower head is installed and shifted vertically, able to enhance sealing effect and prolong the service life of the sealing member.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
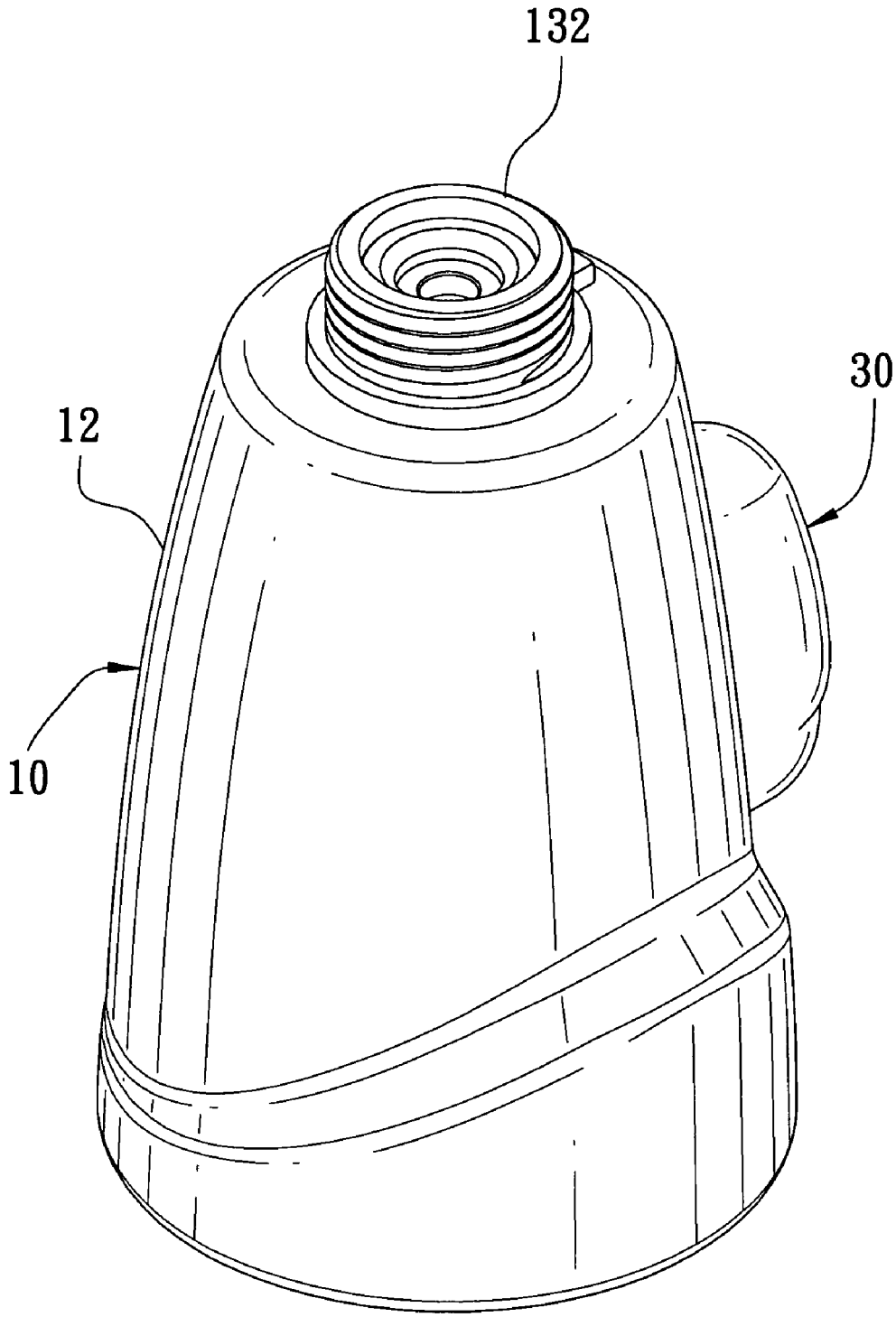
FIG. 1 is a perspective view of a first preferred embodiment of a shower head in the present invention.

A first preferred embodiment of a shower head in the present invention, as shown in FIGS. 1-4, includes a main body 10, a water-separating unit 20 and a press unit 30 as main components combined together.

The main body 10 consists of an inner base 11, an outer casing 12, a water inflow unit 13 and a water outflow unit 14.

Figure 5:
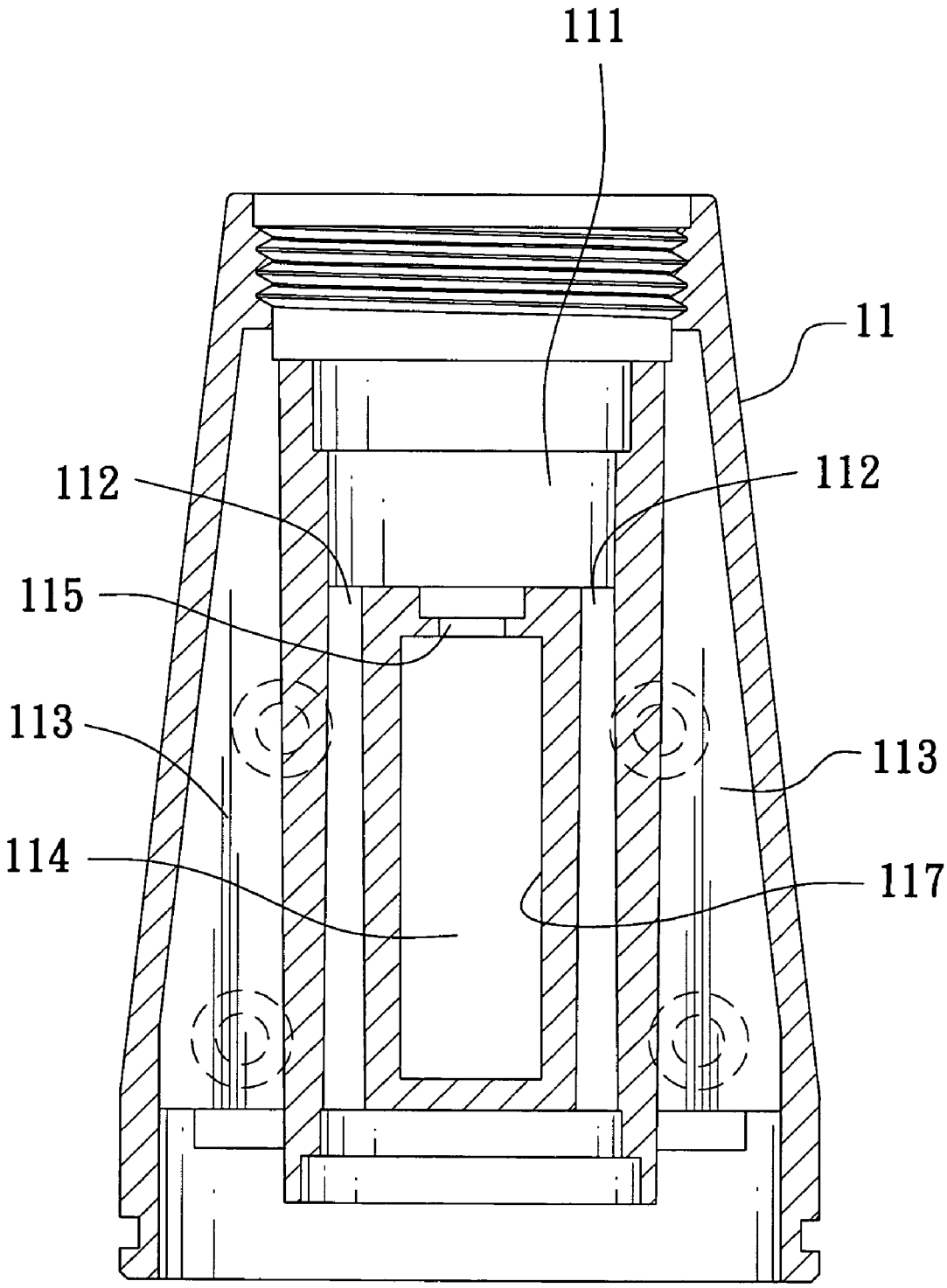
FIG. 5 is a cross-sectional view of the inner base of the shower head in the present invention.

The inner base 11, as shown in FIG. 5, has its topside formed with a recessed opening 111 having the opposite sides of its bottom wall respectively bored with a through central passageway 112 extending downward and also having the opposite sides of its upper circumferential wall respectively bored with a through peripheral passageway 113. Further, the inner base 11 has its intermediate interior formed with an accommodating space 114 having its upper end bored with an insert hole 115 communicating with the recessed opening 111 and its inner wall formed with an upper and a lower rail groove 116 aligned to each other and also its outer wall bored with a through opening 117.

The outer casing 12 to be fitted around the inner base 11 from above is bored with an opening 121 to be corresponding to the outer wall of the accommodating space 114 of the inner base 11.

The water inflow unit 13 consists of a spring holder 131, a pipe coupler 132 and a one-way valve 133. The spring holder 131 to be received in the recessed opening 111 in the upper end of the inner base 11 has its upper end bored with a recessed groove 131*a* having a shaft hole 131*b* in the center and has its lower end bored with a plurality of groove slots 131*c* communicating with the central passageway 112 of the inner base 11. Further, the recessed groove 131*a* of the spring holder 131 has its upper opening formed with a second wall 131*d*.

Figure 6:
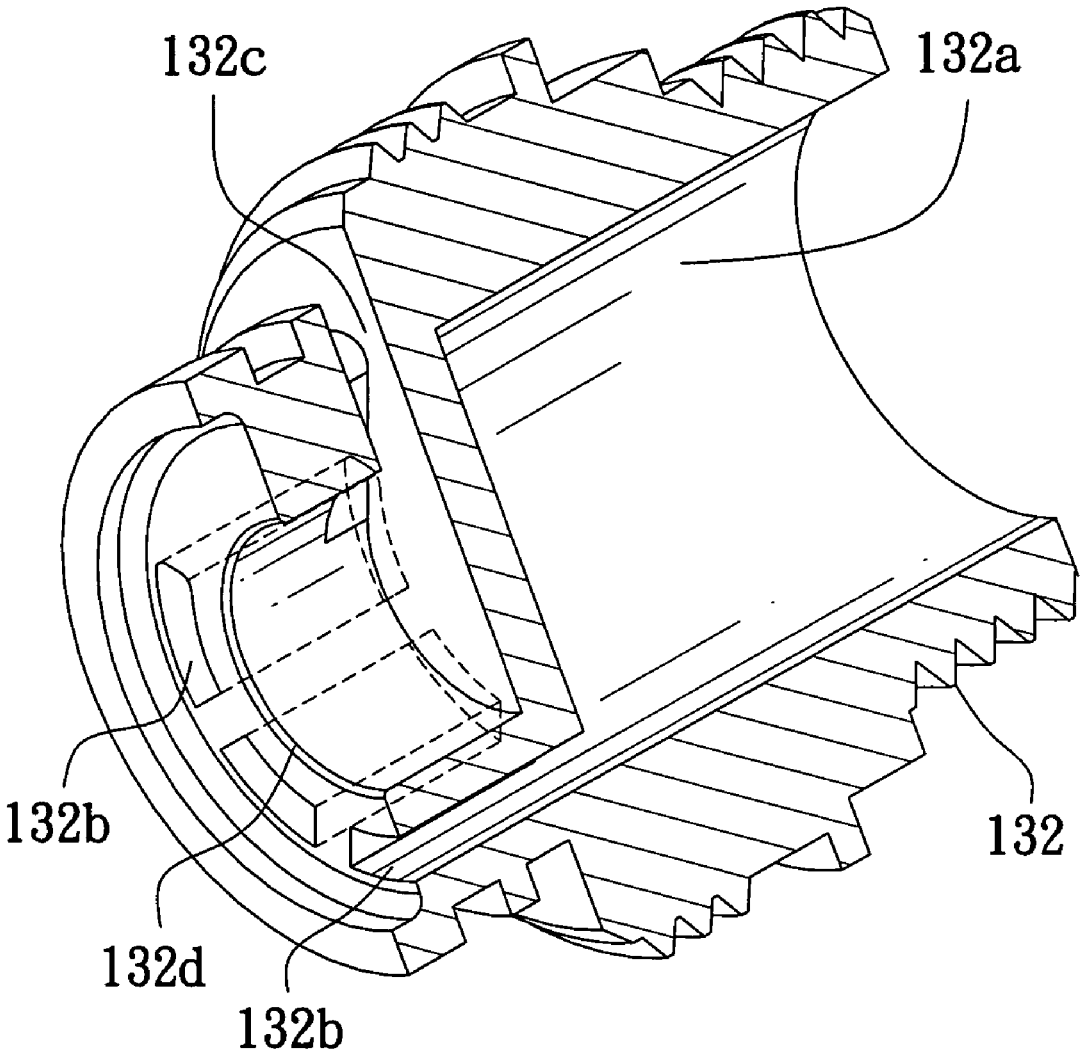
FIG. 6 is a partial perspective cross-sectional view of the pipe coupler of the shower head in the present invention.
Figure 7:
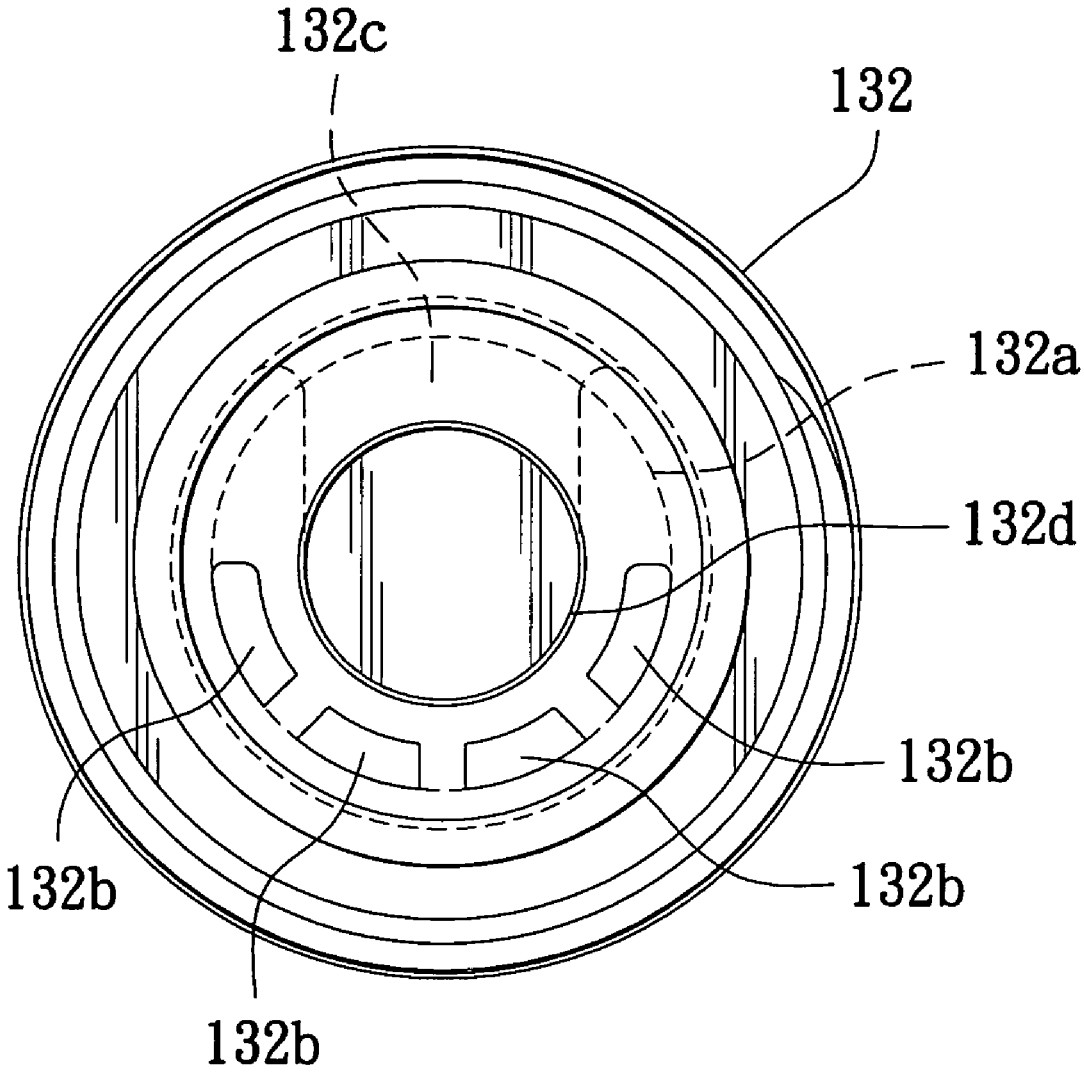
FIG. 7 is a bottom view of the pipe coupler in the present invention.

The pipe coupler 132, as shown in FIGS. 6 and 7, is threadably assembled in the recessed opening 111 of the inner base 11, having its upper side formed with an accommodating groove 132*a* and a plurality of first passageways 132*b* bored in the circumference of one side of its bottom wall of the first accommodating groove 132*b* and extending to the bottom of the pipe coupler 132. Further, the pipe coupler 132 is bored with a second passageway 132*c* extending inward and then downward in the outer circumferential wall of the other side opposite to the first passageways 132*b*, letting one end of the second passageway (132*c*) communicate with the peripheral passageway 113 at the upper end of the recessed opening 111 of the inner base 11. The second passageway 132*c* has the other end positioned at the lower center of the pipe coupler 132 and formed with an annular first wall 132*d*. Furthermore, a chamber 134 defined by the bottom of the pipe coupler 132 and the upper groove slots 131*c* of the spring holder 131 communicates with the first passageways 132*b* and the second passageway 132*c* of the pipe coupler 132 as well as the groove slots 131*c* of the spring holder 131.

The one-way valve 133 to be received in the accommodating groove 132*a* at the upper end of the pipe coupler 132 has a tubular body 133*a*, a base portion 133*b* positioned under the tubular body 133*a*, a valve rod 133*c* positioned between the tubular body 133*a* and the base portion 133*b*, and a spring 133*d* installed between the valve rod 133*c* and the base 133*b*. The spring 133*d* can actuate the valve rod 133*c* to push against and seal the inner wall of the upper opening of the tubular body (133*a*), and the valve rod 133*c* can be forced by preset water pressure to move downward and compress the spring 133*d* to form a water inlet 135. Moreover, the base portion 133*b* has its circumference bored with a plurality of flow holes 133*e* through which water can flow into the accommodating groove 132*a* of the pipe coupler 132. The structure of the one-way valve, being the same as that of a conventional one, is not to be described therein.

The water outflow unit 14 is composed of a disc body 141 and a foaming member 142. The disc 141 is formed with a bottom wall 141*a* having its upper inner and outer side respectively protruding upward to form an inner annular wall 141*b* and an outer annular wall 141*c*. The inner annular wall 141*b* of the disc 141 is fitted and sealed with the bottom circumference of the central passageway 112 of the inner base 11, and the outer annular wall 141*c* of the disc 141 is fitted and sealed between the lower ends of the inner base 11 and the outer casing 12 to separate the central passageways 112 from the peripheral flow passageways 113 at the lower side of the inner base 11. Further, the disc 141 has the bottom wall 141*a* within the inner annular wall 141*b* bored with a through opening 141*d* and the bottom wall 141*a* between the inner annular wall (141*b*) and the outer annular wall 141*c* annularly bored with lots of small peripheral water outlets 141*e*. The foaming member 142 is threadably mounted on the through opening (141*d*) of the disc 141 and bored with lots of small central water outlets 142*a* through which water flows out in foaming condition. The structure of the foaming member 142, being the same as that of a conventional one, is not to be described here.

Figure 8:
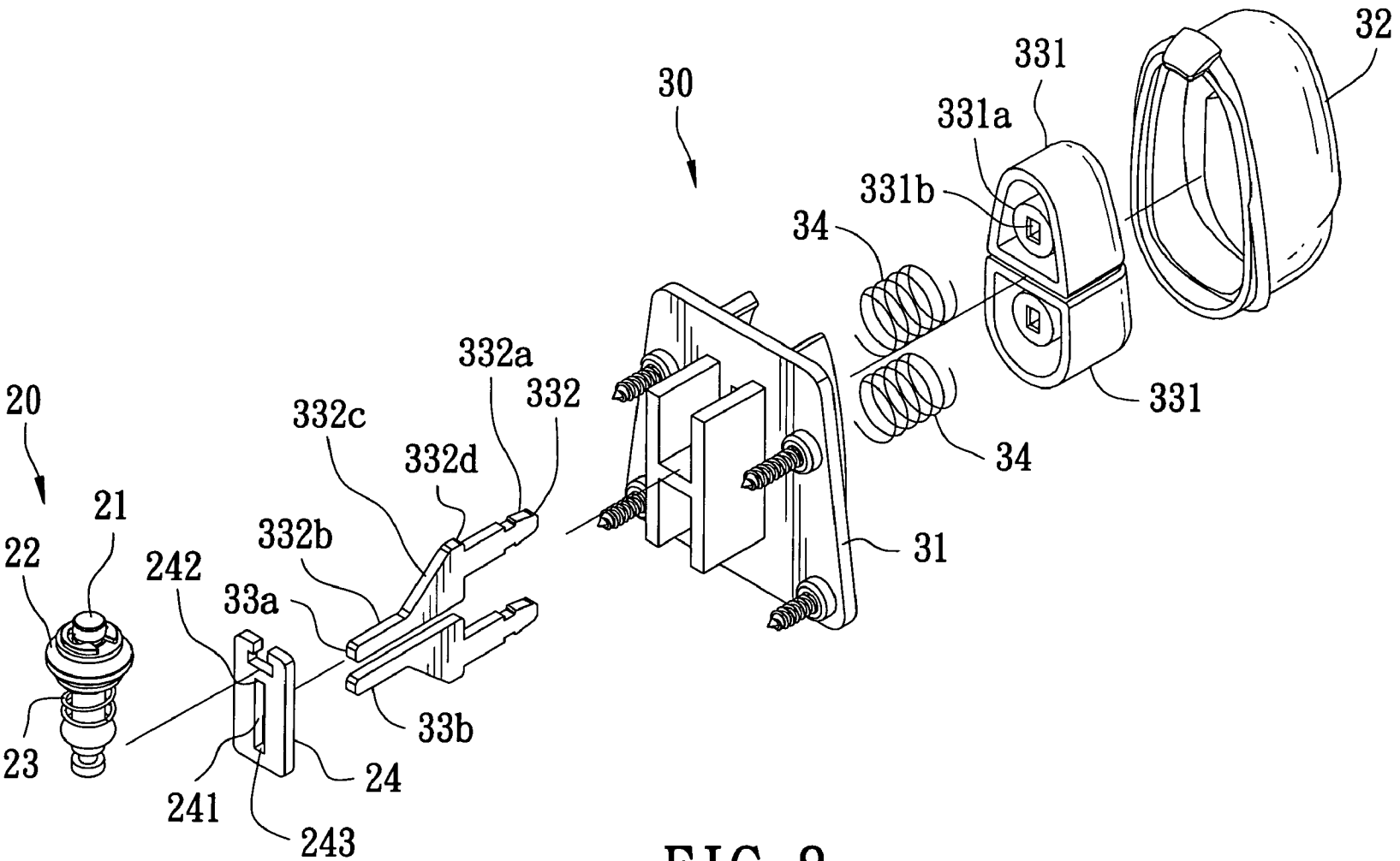
FIG. 8 is an exploded perspective view of a water-separating unit and a press unit of the shower head in the present invention.

The water-separating unit 20, as shown in FIG. 8, consists of a pivot 21, a sealing member 22, an elastic member 23 and a coupling plate 24.

The pivot 21 is vertically inserted in both the insert hole 115 of the inner base 11 and the shaft hole 131*b* of the spring holder 131 of the water inflow unit 13, having the opposite ends respectively positioned in the upper chamber 134 and in the accommodating space 114 of the inner base 114.

The sealing member 22 is firmly fitted on the upper end of the pivot 21, able to be moved up and down together with the pivot 21 in the chamber 134. When moved upward, the sealing member 22 will resist and seal the annular first wall 132*d* at the bottom of the pipe coupler 132 to let the water inlet 135 only able to communicate with the central water outlets 142*a* of the foaming member 142. When moved downward, the sealing member 22 will resist and seal the second wall 131*d* at the upper end of the spring holder 131 to let the water inlet 135 only able to communicate with the peripheral water outlets 141*e* of the disc 141.

The elastic member 23, being a spring in this preferred embodiment, is fitted around the upper portion of the pivot 21, having its opposite ends respectively pushing against the sealing member 22 and a relative portion of the upper recessed groove 131*a* of the spring holder 131. The pivot 21 together with the sealing member 22 can be moved upward by the elastic force of the elastic member 23 to normally keep the sealing member 22 and the first wall 132*d* of the pipe coupler 132 in a mutually sealed condition, and the sealing member 22 can be actuated by preset water pressure to move downward and compress the elastic member 23.

The coupler plate 24 has its upper end firmly engaged with the lower end of the pivot 21 and its intermediate portion cut with a vertical slot 241 having the upper and the lower side respectively formed with a pushing wall 242, 243.

The press unit 30, as shown in FIG. 8, is composed of a base plate 31, a press cover 22, a first actuating member 33*a*, a second actuating member 33*b* and two elastic members 34.

The base plate 31 is secured at the opening 117 of the intermediate accommodating space 114 of the inner base 11 and bored with an upper and a lower insert hole 311 aligned to each other.

The press cover 32 made of flexible material is fixed with and exposed out of the opening 121 in the circumferential side of the outer casing 12 and formed with a first press portion 321 and a second press portion 322 respectively able to be pressed and produce flexible deformation.

The first and the second actuating member 33*a*, 33*b* respectively consist of a press block 331 and an elongate actuating block 332. The two press blocks 331 are respectively positioned high and low between the base plate 31 and the press cover 32, able to be respectively actuated to move inward after the first and the second press portion 321, 322 of the press cover 32 are respectively pressed and deformed inward. The two press blocks 331 are respectively formed with a stud 331*a* at the central portion of one side facing the base plate 31, and each stud 331*a* is bored with an insert slot 331*b* in the center. The two elongate actuating blocks 332 respectively have one end formed with an insert portion 332*a* to be inserted through the insert hole 311 of the base plate 31 and then inserted in the central insert slot 331*b* of the press block 331. The two elongate controlling blocks 332 respectively have the other end formed with a sliding portion 332*b* to be inward inserted through the vertical slot 241 of the coupling plate 24 and then positioned in the rail groove 116 of the inner base 11 to be guided to slide therein. Further, the two elongate actuating blocks 332 have their intermediate portions at the inner side of the base plate 31 respectively formed with a pushing slope 332*c* positioned in opposite direction. Thus, when the actuating block 332 of the first actuating member 33*a* is shifted inward horizontally together with the press block 331, the pushing slope 332*c* will push upward against the upper wall 242 of the vertical slot 241 of the coupling plate 24 and actuate the pivot 21 to move upward vertically. In the same way, when the actuating block 332 of the second actuating member 33*b* is shifted inward horizontally together with the press block 331, the pushing slope 332*c* will push downward against the lower wall 243 of the vertical slot 241 of the coupling plate 24 and actuate the pivot 21 to move downward vertically. In addition, each pushing slope 332*c* of the actuating block 332 has its outer side formed with a stepped stopping edge 332*d* for resisting against the inner wall of the base plate 31 and being positioned thereon.

The two elastic members 34, being springs in this preferred embodiment, are respectively fitted on the studs 331*a* of the two press blocks 331 of the first and the second actuating member 33*a*, 33*b*, and have their inner ends respectively pushing against the outer wall of the base plate 31. Thus, the two press blocks 331 can be pushed by the elastic members 34 to move outward horizontally until the stopping edges 332*d* of the actuating blocks 332 are stopped at the inner wall of the base plate 31 to let the pushing slopes 332*c* of the controlling blocks 332 normally disengaged from the upper and the lower wall 242, 243 of coupling plate 24 of the water-separating unit 20.

In a normal state of the press unit 30 not being pressed, the spray head of this invention will keep sending out water from the center, but the press unit 30 can be optionally pressed for sending out water from the center or from the periphery.

Figure 2:
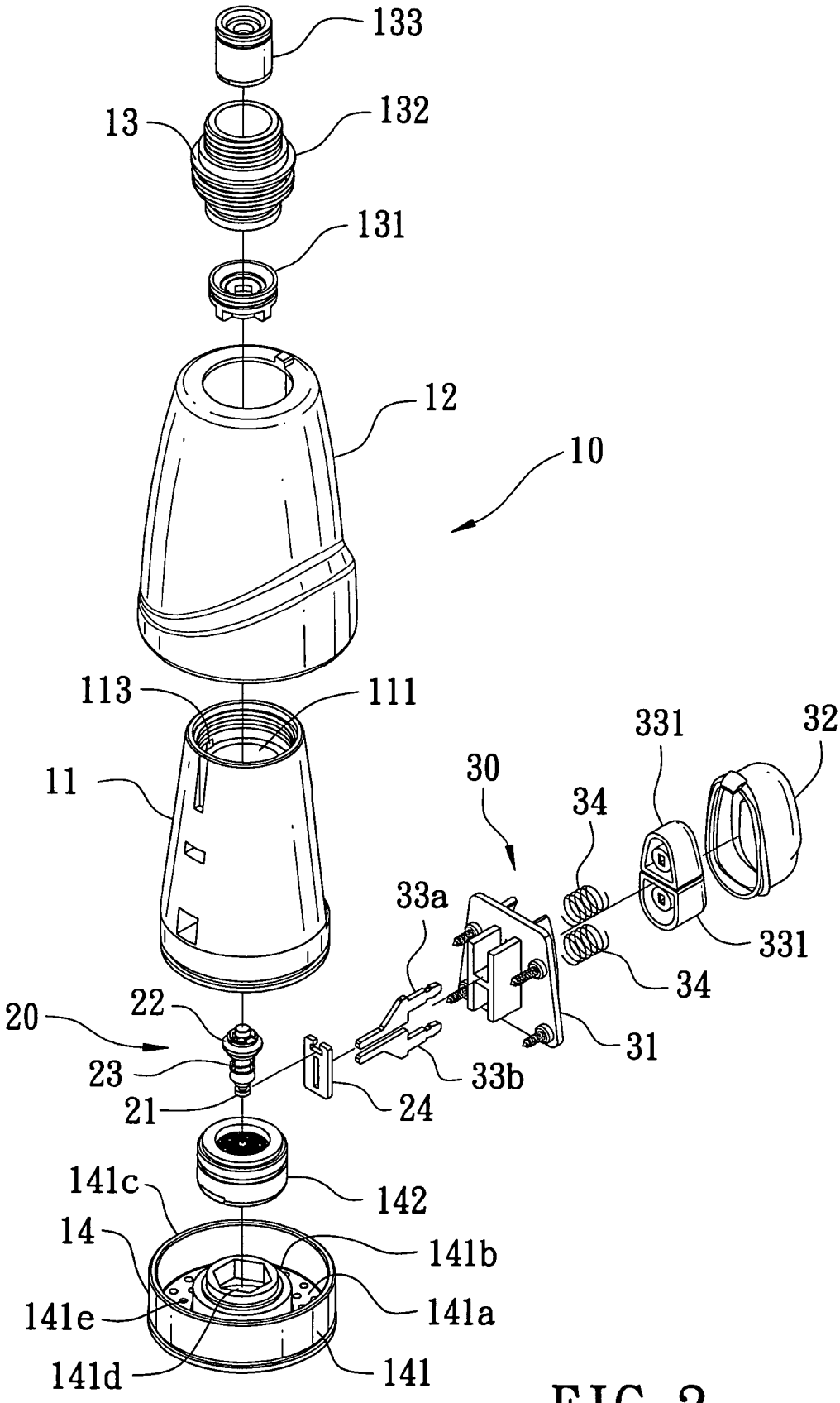
FIG. 2 is an exploded perspective view of the first preferred embodiment of the shower head in the present invention.
Figure 3:
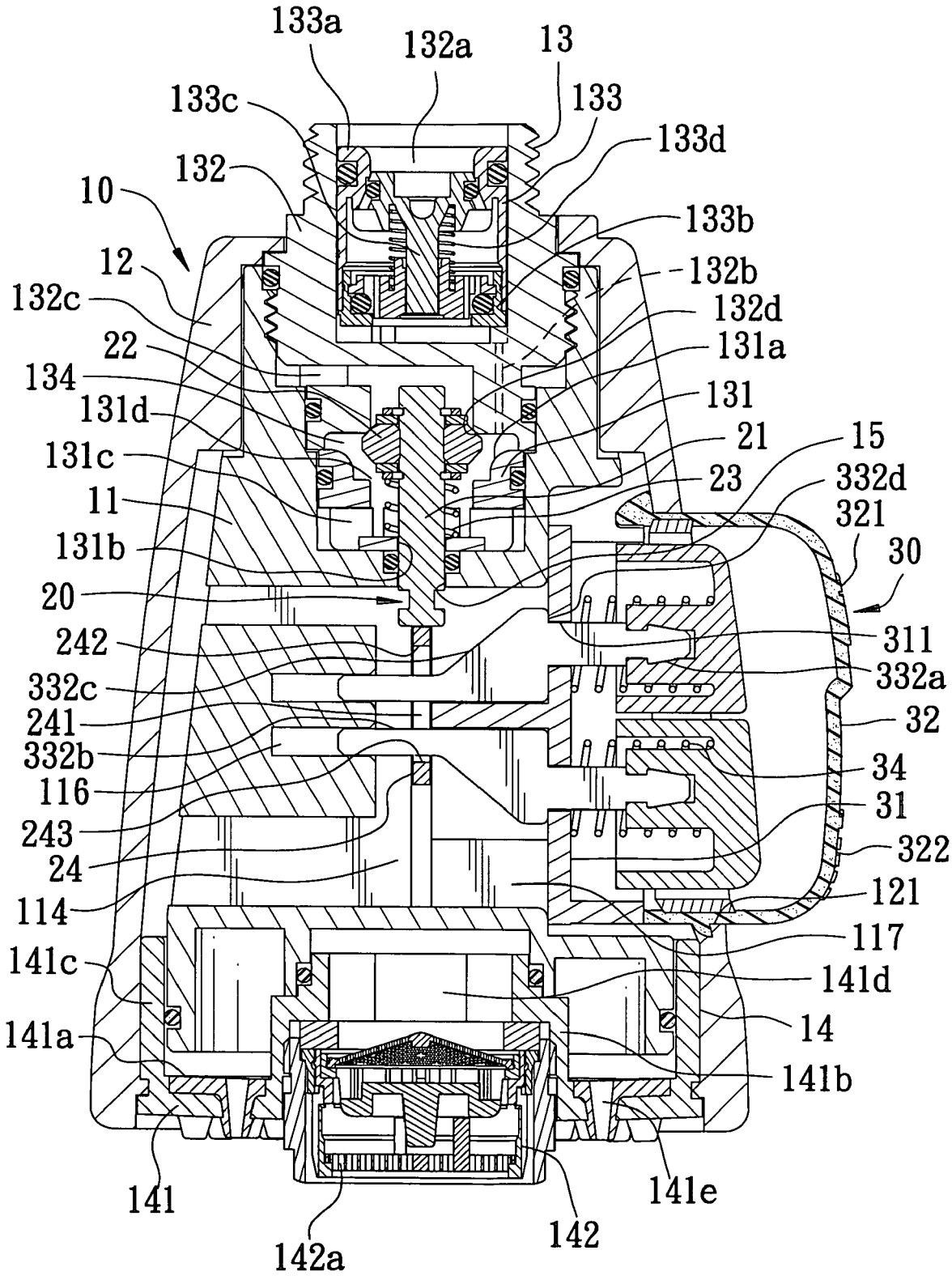
FIG. 3 is a side cross-sectional view of the first preferred embodiment of the shower head in the present invention.
Figure 4:
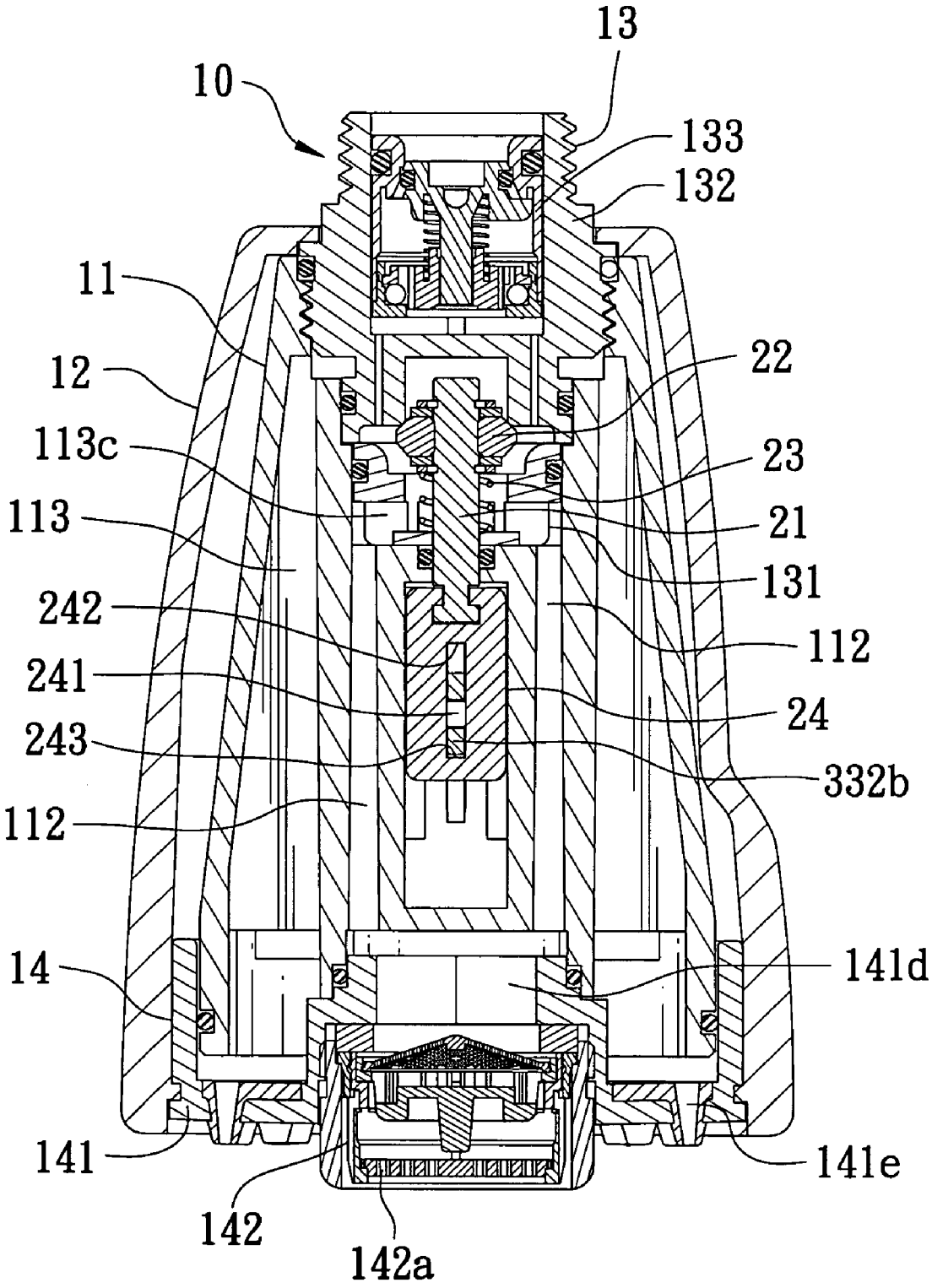
FIG. 4 is another side cross-sectional view of the first preferred embodiment of the shower head in the present invention.
Figure 12:
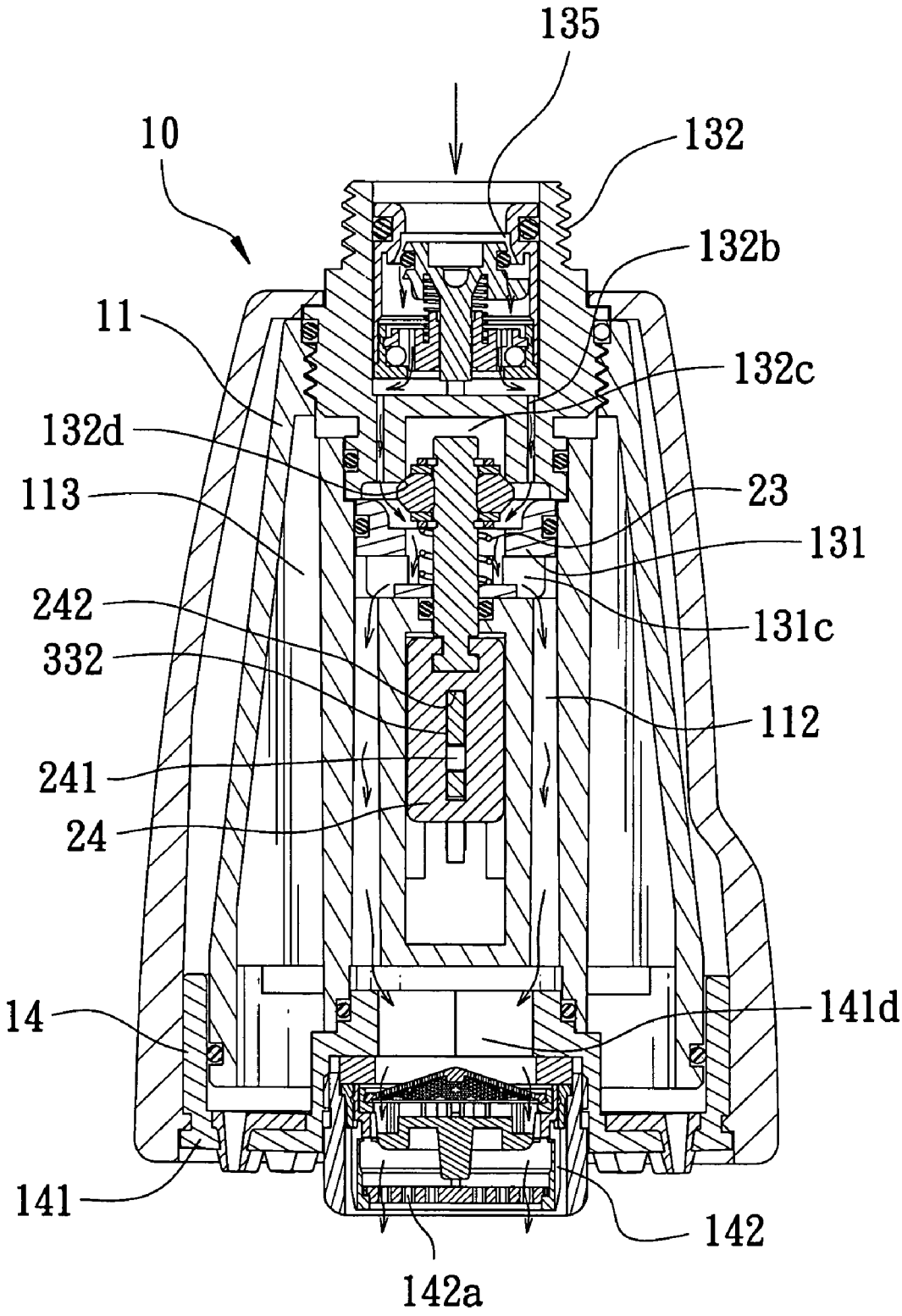
FIG. 12 is another side cross-sectional view of the first preferred embodiment of the shower head pressed for sending out water through the center in the present invention.

Referring to FIGS. 2 and 3, when the spray head is pulled downward out and the press unit 30 is not yet pressed, the pivot 21 of the water-separating unit 20 will be pushed upward by the elastic member 23 and the sealing member 22 on the pivot 21 will be actuated to push against the first wall 132*d* of the chamber 134, letting the water inlet 135 of the main body 10 only able to communicate with the central water outlet 142*a*. In other words, after water flows into the chamber 134 of the inner base 11 through the water inlet 135 of the inner base 11 and the first passageway 132*b* of the pipe coupler 132, the water will flow toward the bottom of the main body 10 through the groove slots 131*c* at the bottom of the spring holder 131 and through the central flow passageway 112 of the inner base 11. Then, the water will be sent out through the central through opening 141*d* of the disc 141 of the water-separating unit 14 and through the central water outlets 141*a* of the foaming member 142, as shown in FIG. 12. The water sent out through the foaming member 142 will become foamed.

Figure 9:
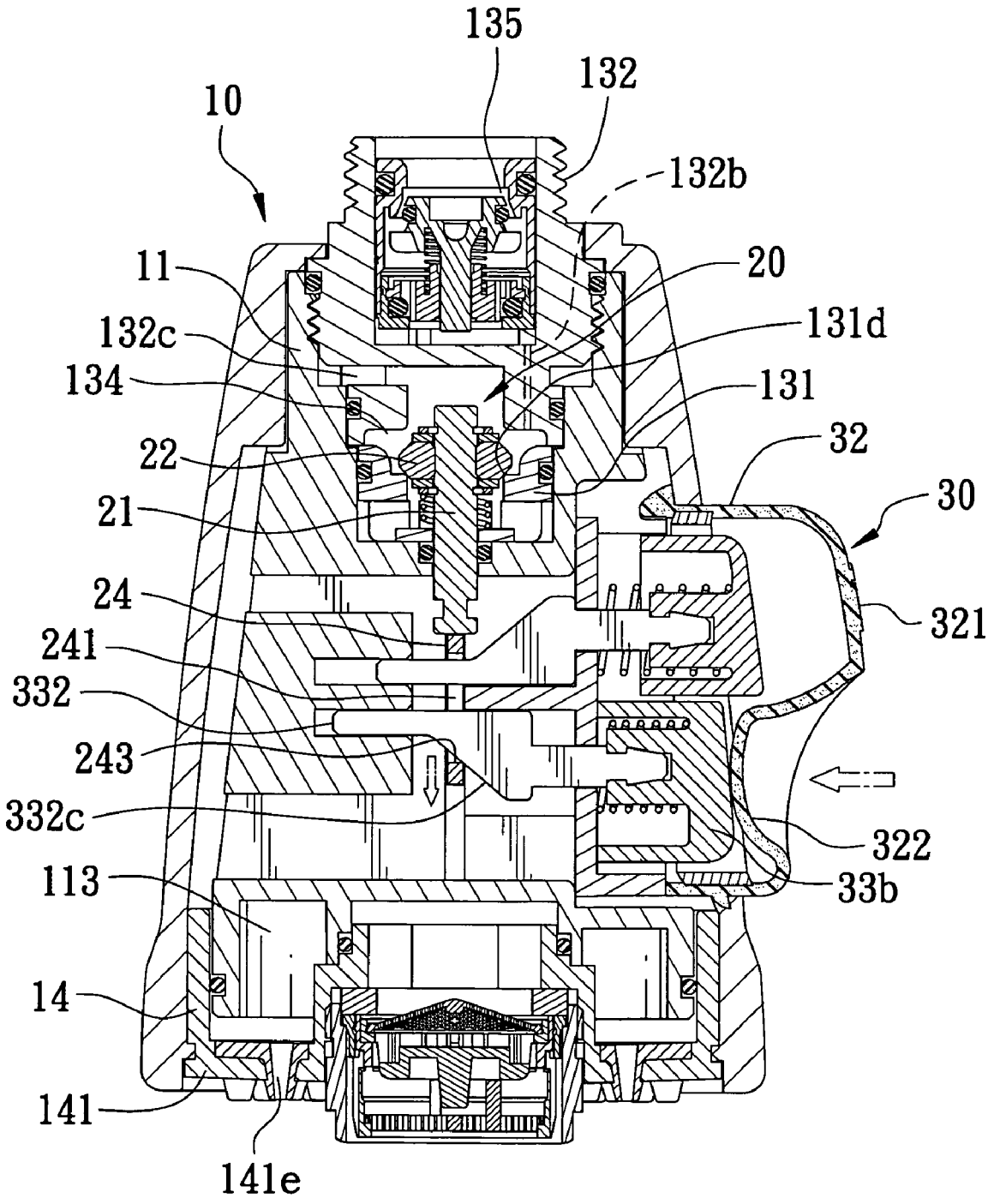
FIG. 9 is a side cross-sectional view of the first preferred embodiment of the shower head pressed for sending out water through the periphery in the present invention.
Figure 10:
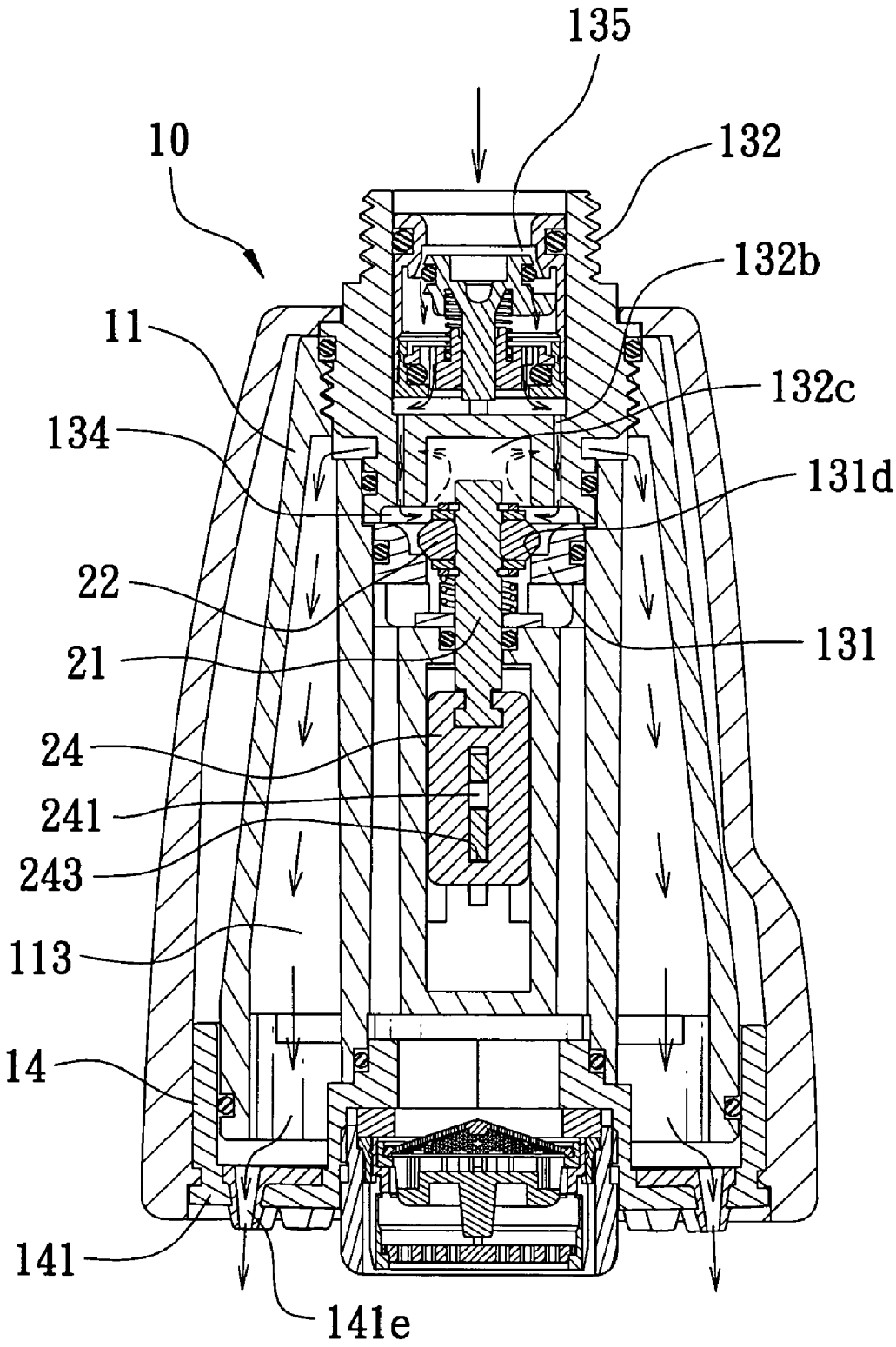
FIG. 10 is another side cross-sectional view of the first preferred embodiment of the shower head pressed for sending out water through the periphery in the present invention.

To send out water from the periphery, as shown in FIGS. 9 and 10, only press the second press portion 322 of the press cover 32 of the press unit 30 to let the press cover 32 deformed inward to press the second actuating member 33*b* to move inward horizontally. At this time, the second actuating member 33*b* with the help of the pushing slope 332*c* of the controlling block 332 will push downward against the lower wall 243 of the coupling plate 24 of the water-separating unit 20 to actuate the coupling plate 24 together with the pivot 21 to move downward vertically to let the sealing member 22 on the pivot 21 resist and seal the second wall 131*d* of the spring holder 131. Thus, the water inlet 135 of the inner base 11 can only communicate with the peripheral water outlets 141*e* of the disk 141 of the water outflow unit 14. In other words, after water flows into the chamber 134 through water inlet 135 of the inner base 11 and the first passageway 132*b* of the pipe coupler 132, water will flow toward the bottom of the inner base 11 thorough the second passageway 132*c* of the pipe coupler 132 and the peripheral passageway 113 of the inner base 11 and then be sent out thorough all the peripheral water outlets 141*e* of the disc 141 of the water outflow unit 14, thus achieving the effect of sending out water through the periphery. After water flows out through all the peripheral outlets 141*e* of the disc 141, water flowing in the chamber 134 can produce enough water pressure to continuously press downward the sealing member 22 of the pivot 21 to let the sealing member 22 tightly push against the second wall 131*d* of the spring holder 131 and enable the spray head to automatically keep sending out water through the periphery. Therefore, after being pressed, the second press portion 322 of the press cover 32 can be released immediately, needless to be pressed continuously.

Figure 11:
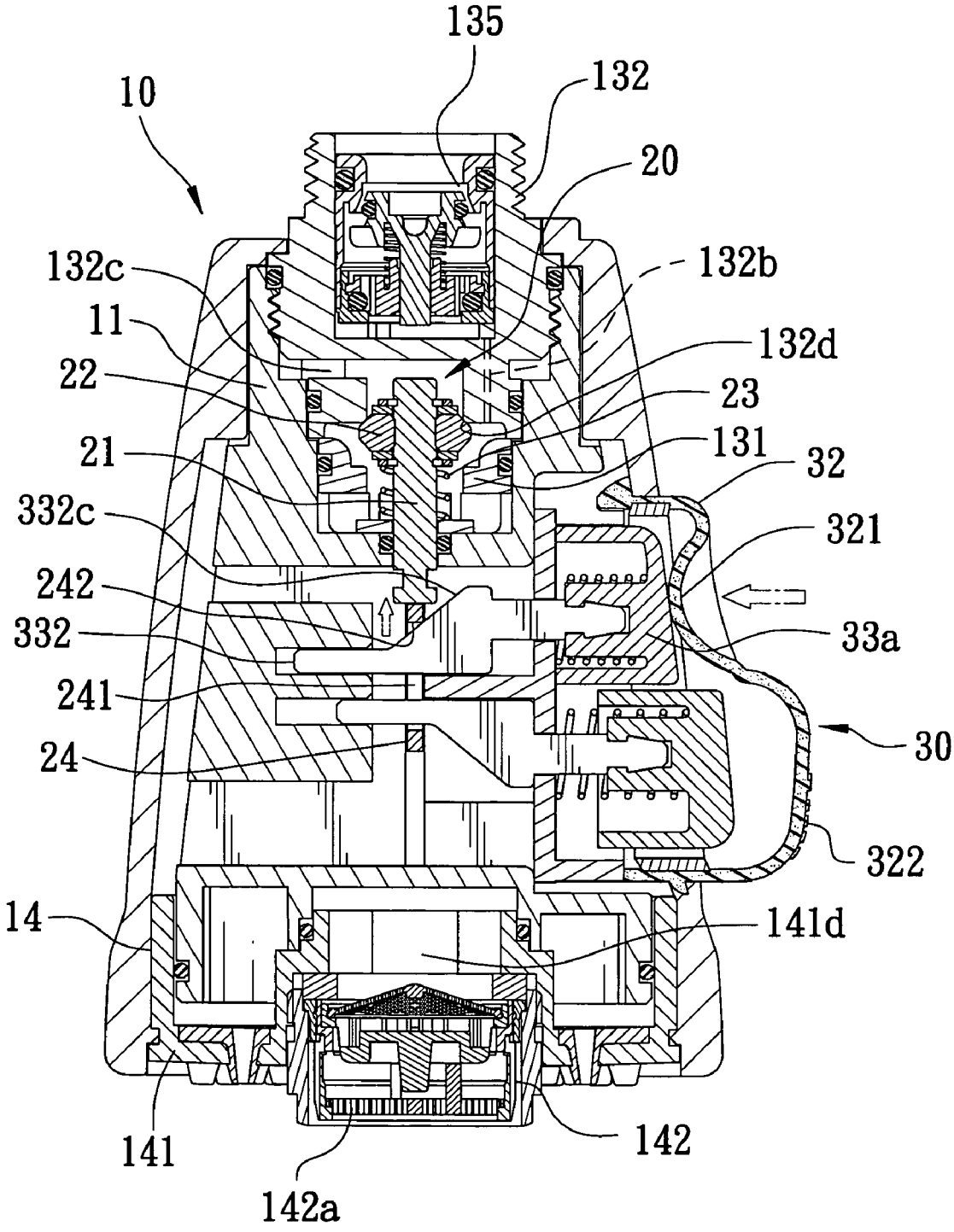
FIG. 11 is a side cross-sectional view of the first preferred embodiment of the shower head pressed for sending out water through the center in the present invention.

To recover sending out water through the center, as shown in FIGS. 11 and 12, simply press the first press portion 321 of the press cover 32 of the press unit 30 to let the press over 32 deformed inward and push the first actuating member 33*a* to shift inward horizontally. At this time, the first actuating member 33*a* with the help of the pushing slope 332*c* of the actuating block 332 will push downward against the upper wall 242 of the couple plate 24 of the water-separating unit 20 and actuate the coupling plate 24 and the pivot 21 to move upward vertically to let the sealing member 22 on the pivot 21 recover to resist and seal the first wall 132*d* at the lower end of the pipe coupler 132. Thus, the water inlet 135 of the inner base 11 can only communicate with the central water outlets 142*a* of the foaming member 142. In other words, after water flows into the chamber 134 through the water inlet 135 of the inner base 11 and the first passageway 132.*b* of the pipe coupler 132, water will flow toward the bottom of the inner base 11 through the groove slots 131*c* at the lower end of the spring holder 131 and through the central passageways 112 of the inner base 11 and then be sent out through the central through opening 141*d* of the disc 141 of the water outflow unit 14 and through all the central water outlets 142*a* of the foaming member 142, letting the spray head recover to normally keep sending out water through the center. Since the elastic member 23 of the water-separating unit 20 can promptly push the sealing member 22 to move upward and seal the first wall (132*d*) of the pipe coupler 132; therefore, after the being pressed, the first press portion 321 of the press cover 32 can be released immediately, needless to be pressed continuously.

Figure 13:
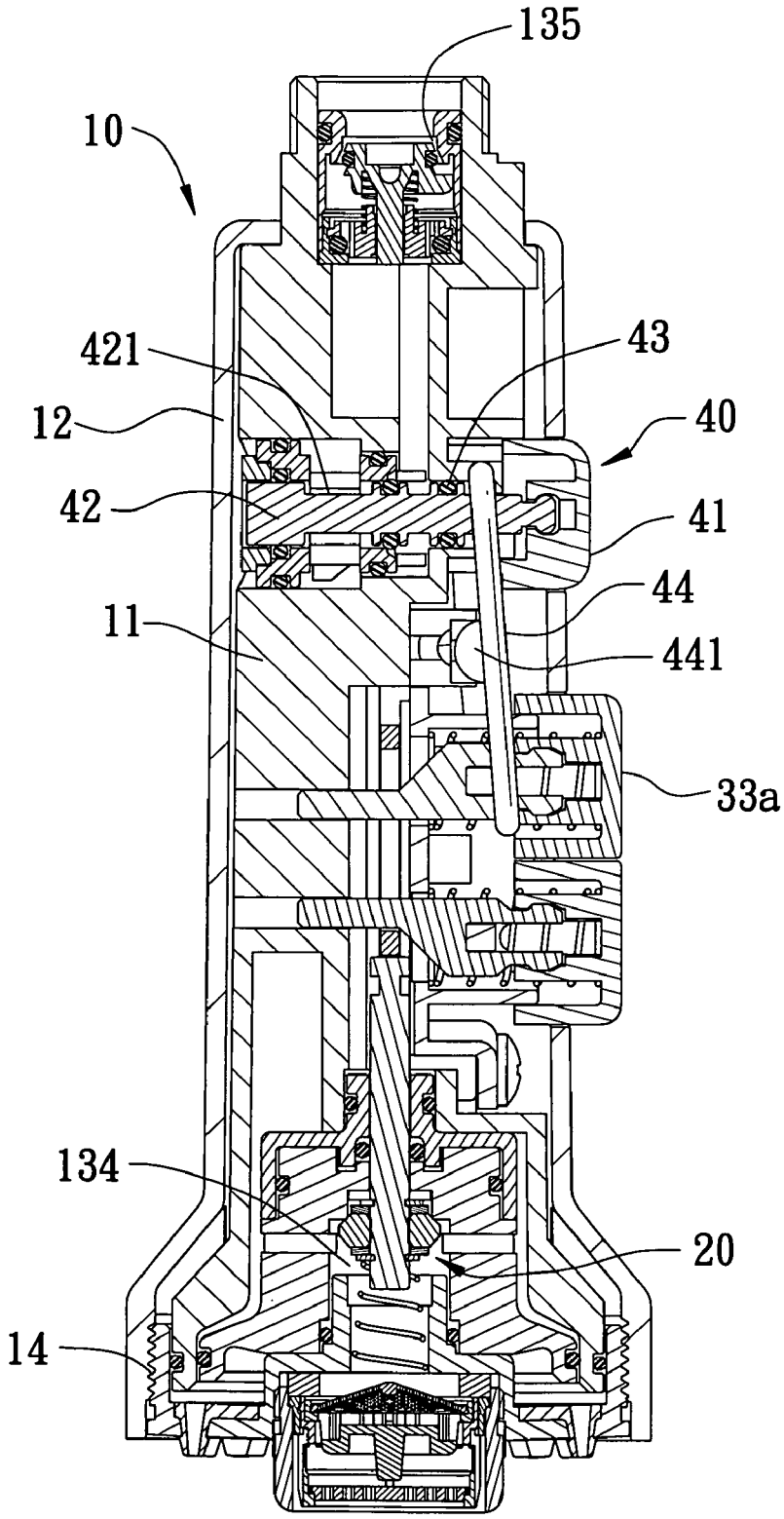
FIG. 13 is a side cross-sectional view of a second preferred embodiment of a shower head in the present invention.
Figure 14:
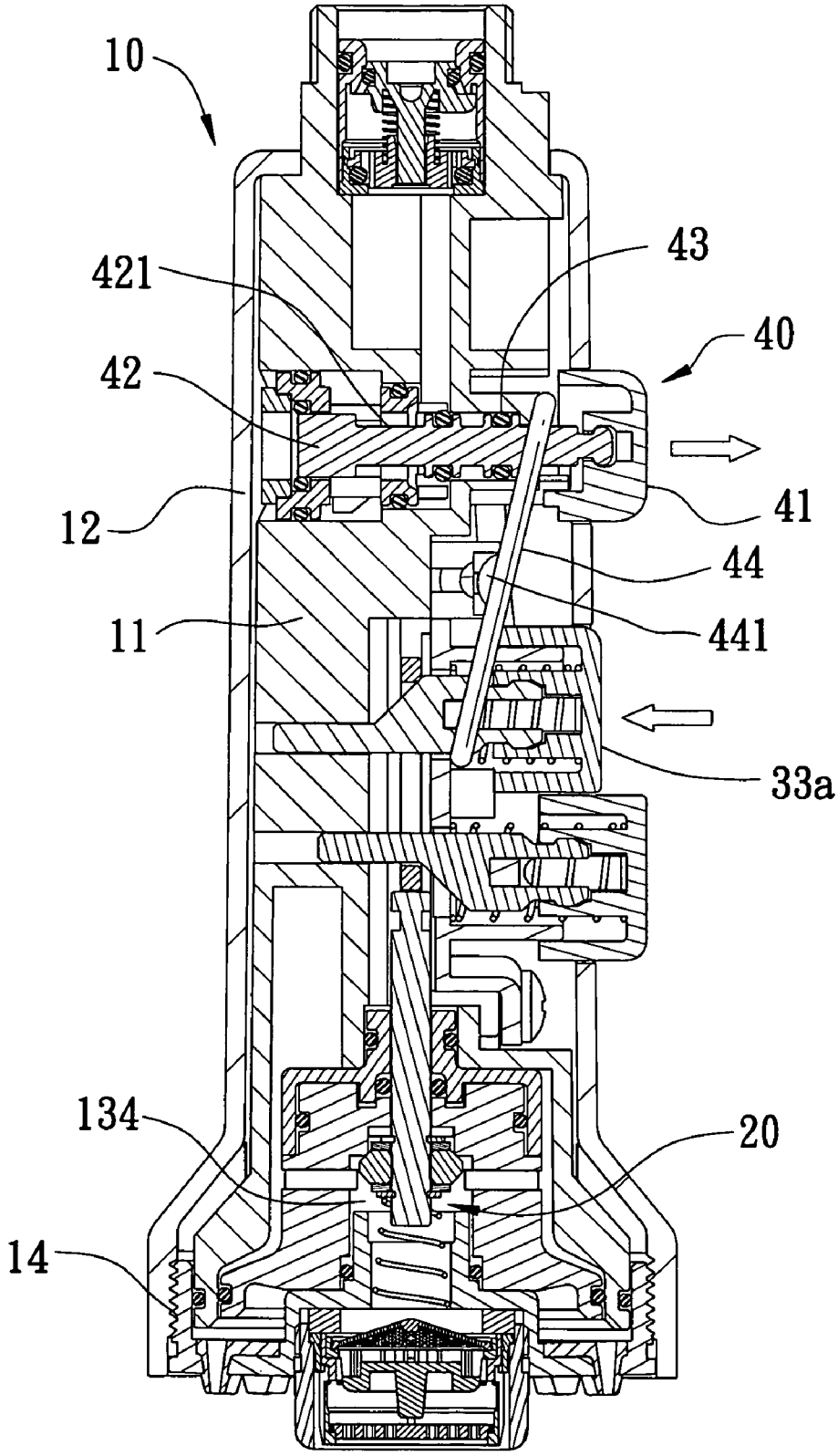
FIG. 14 is a side cross-sectional view of the second preferred embodiment of the shower head in an operating condition in the present invention.

A second preferred embodiment of a spray head in the present invention, as shown in FIGS. 13 and 14, is to have a water-separating unit 20 installed between the lower end of the inner base 11 and the water outflow unit 14, the structure and the principle of the water-separating unit 20 of the second preferred embodiment being the same as that described in the first preferred embodiment. A water-stopping valve 40 is transversely installed at the upper end of the inner base 11, having a press button 41 coupled with a horizontal slide rod 42 that is bored with an annular groove 421 and disposed thereon with a plurality of sealing members 43. A coupling rod 44 has its opposite ends respectively connected with the slide rod 42 and a preset portion of the first actuating member 33*a* and has its intermediate portion provided with a protruding fulcrum 441 resting on a relative wall of the inner base 11 for producing leverage. Therefore, under the condition of the first actuating member 33*a* not being pressed, the coupling rod 44 will produce leverage to keep the slide rod 42 of the water-stopping valve 40 and the press button 41 under a contracted condition so as to enable the sealing members 43 on the slide rod 42 to seal up the flow passageway through which water coming from the water inlet 135 of the inner base 11 flows into the chamber 134. Thus, in a normal state, the water-stopping valve 40 can function to stop the spray head from sending out water. On the contrary, when the first press member 33*a* is pressed, the coupling rod 44 will produce leverage and actuate the slide rod 42 of the water-stopping valve 40 and the press button 41 to move and protrude outward to enable the annular groove 421 of the slide rod 42 to communicate with the flow passageway through which water coming from the water inlet 135 of the inner base 11 flows into chamber 134. By so designing, the water-stopping valve 40 can be interactively opened to enable the shower head to send out water through the center or from the periphery.

As can be understood from the above description, this invention has the following advantages.

1. In a normal state, the spray head of this invention can be normally kept in a condition of sending out water through the center, and the press unit 30 can be optionally pressed for sending out water through the center or the periphery.

2. When the press unit 30 is pressed, the inflow water pressure or the restoring force of the elastic member 23 is able to keep the sealing member 22 in a sealed condition; therefore, after being pressed, the press unit 30 can be released immediately to let the shower head automatically keep sending out water through the periphery or the center, convenient in use and conforming to the humanized design.

3. The water-separating unit 20 is installed and operated vertically; therefore, the direction of gravitational force imposed upon the water-separating unit 20 is in line with the working and shifting direction of the water-separating unit 20, able to enhance sealing effect and prolong the service life of the sealing member 22.

While the preferred embodiments of the invention have been described above, it will be recognized and understood that various modifications may be made therein and the appended claims are intended to cover all such modifications that may fall within the spirit and scope of the invention.

We claim:

1. A shower head comprising:

a main body having one end formed with a water inlet and the other end formed with at least one central water outlet and a plurality of peripheral water outlets, said main body having its interior formed with a chamber communicating with said water inlet and said central water outlets as well as said peripheral water outlets, said chamber formed with a first wall and a second wall:

a water-separating unit installed in the interior of said main body and provided with a pivot able to be moved up and down vertically, said pivot fitted thereon with a sealing member, said sealing member actuated by an elastic member to normally push against and seal said first wall inside said chamber of said main body so that said water inlet can only communicate with said central water outlets of said main body, said pivot able to be actuated to shift vertically toward said elastic member to let said sealing member push against and seal said second wall inside said chamber of said main body so that said water inlet can only communicate with said peripheral water outlets: and a press unit positioned in the interior of said main body and composed of a first actuating member and a second actuating member, said first and said second actuating member able to be respectively and elastically pressed to move inward horizontally, said first and said second actuating member respectively formed with a pushing slope in opposite directions, said sealing member on said pivot actuated to push against and seal up said first wall when said pushing slope of said first actuating member is moved inward horizontally to push said pivot to move upward vertically, said sealing member actuated to push against and seal up said second wall when said pushing slope of said second actuating member is moved inward horizontally to push said pivot to move downward vertically.

2. The shower head as claimed in claim 1, wherein said main body has an inner base, an outer casing mounted around said inner base, a water inflow unit assembled at the upper end of said inner base, and a water outflow unit installed at the lower end of said inner base.

3. The shower head as claimed in claim 2, wherein said inner base has its upper end formed with a recessed opening for receiving said water inflow unit and said water-separating unit, said recessed opening having its bottom wall bored with at least one center passageway, said recessed opening having its upper circumferential wall bored with at least one peripheral passageway, said inner base having the intermediate interior formed with an accommodating space, said accommodating space having its upper end formed with an insert hole communicating with said recessed opening, said pivot of said water-separating unit inserted through said insert hole and positioned in said accommodating space of said inner base, said accommodating space of said inner base having one side bored with an opening for assembling said press unit therein.

4. The shower head as claimed in claim 3, wherein said inner base has the preset wall in said accommodating space provided with two rail grooves respectively for the relative ends of said first and said second actuating member of said press unit to be inserted and guided to slide therein.

5. The shower head as claimed in claim 2, wherein said water inflow unit is composed of a spring holder received in said recessed opening at the upper end of said inner base and a pipe coupler, said spring holder having its upper end formed with a recessed groove receiving one end of said elastic member of said water-separating unit, said recessed groove of said spring holder bored with a shaft hole for said pivot to be inserted therethrough, a space defined between said recessed groove and the lower end of said pipe coupler to form an inner chamber of said main body, said spring holder having its bottom bored with least one groove slot communicating with said center passageways of said inner base, said pipe coupler formed with an accommodating groove in the upper end for receiving a one-way valve, said accommodating groove of said pipe coupler bored with a first passageway communicating with said inner chamber of said main body, said pipe coupler having its outer circumferential wall bored with a second passageway communicating with said inner chamber of said main body, said first wall of said main body formed between said first and said second flow passageway at the lower end of said pipe coupler, said sealing member of said water-separating unit actuated to push against and seal said first wall of said main body to separate said first passage way from said second passageway, letting said first passageway only able to communicate with said center passageway of said inner base through said inner cavity and said groove slots of said spring holder.

6. The shower head as claimed in claim 1, wherein said water-separating unit is provided with a coupling plate having its upper end connected with the lower end of said pivot, said coupling plate formed with a vertical slot in the center, the upper and the lower wall of said center vertical slot of said coupling plate able to be respectively pushed to move vertically by said pushing slope of said first and said second actuating member of said press unit.

7. The shower head as claimed in claim 2, wherein said press unit is composed of a base plate, two elastic members and a press cover, said base plate fixedly combined with said opening of said inner base for installing said first and said second actuating member thereon, said two elastic members positioned between said base plate and said first and said second actuating member, said press cover made of flexible material and firmly combined with and properly exposed out of said outer casing, said press cover pressed to produce inward flexible deformation to push said first and said second actuating member to move inward.

8. The shower head as claimed in claim 7, wherein said first and said second actuating member are respectively provided with a press block and an elongate actuating block, said two press blocks disposed between said base plate and said press cover, said two press blocks respectively having the center of one side secured with a stud for said elastic member to be fitted thereon, said two said studs respectively bored with an insert slot in the center, said two elongate actuating blocks respectively having one end formed with an insert portion to be inserted through said base plate and positioned in said insert slot of said press block, said two elongate actuating blocks respectively having the other end formed with a sliding portion to be slidably inserted in said rail groove of said inner base, said pushing slope of said first and said second actuating member respectively positioned at the intermediate portion of said actuating block.

9. The shower head as claimed in claim 2, wherein said water outflow unit is composed of a disc and a forming member, said disc formed with a bottom wall having its topside provided with an inner annular wall and an outer annular wall extending upward respectively, said inner and said outer annular wall of said water outflow unit closely fitted with said inner base for separating said center passageway from said peripheral passageways at the lower end of said inner base, said disc having the bottom wall within said inner annular wall bored with a through opening, said disc having the bottom wall between said inner and said outer annular wall annularly bored with lots of small holes to form said peripheral water outlets of said main body, said foaming member assembled with said through opening of said disc and bored with lots of flow passageways to form said central water outlets of said main body.

10. The shower head as claimed in claim 1, wherein said main body has its upper end transversely installed with a water-stopping valve to be pressed, said water-stopping valve normally sealing up a flow passageway between said water inlet and said chamber of said main body, said water-stopping valve able to be actuated to shift outward and open said flow passageway when said first actuating member of said press unit is pressed.

* * * * *